US006116998A

United States Patent [19]

Damgaard et al.

[11] Patent Number: 6,116,998

[45] Date of Patent: Sep. 12, 2000

[54] ATTACHMENT MEANS AND USE OF SUCH MEANS FOR ATTACHING A SHEET-FORMED ABRASIVE OR POLISHING MEANS TO A MAGNETIZED SUPPORT

[75] Inventors: Morten J. Damgaard, Merløse; Leila Bjerregaard, Herlev, both of Denmark

[73] Assignee: Struers A/S, Rødovre, Denmark

[21] Appl. No.: 09/341,460

[22] PCT Filed: Jan. 13, 1998

[86] PCT No.: PCT/DK98/00016

§ 371 Date: Jul. 16, 1999

§ 102(e) Date: Jul. 16, 1999

[87] PCT Pub. No.: WO98/30359

PCT Pub. Date: Jul. 16, 1998

[30] Foreign Application Priority Data

Jan. 13, 1997 [DK] Denmark ..... 0041/97

[51] Int. Cl.[7] ..... B24D 17/00

[52] U.S. Cl. ..... 451/490; 451/494; 451/538; 451/539

[58] Field of Search ..... 451/28, 526, 494, 451/529, 533, 534, 538, 539, 544, 490; 29/458, 460, 527.2

[56] References Cited

U.S. PATENT DOCUMENTS 4,222,204 9/1980 Benner .
4,558,542 12/1985 Marton .
4,607,464 8/1986 Schwartz .
4,667,447 5/1987 Barton .
5,573,816 11/1996 Gaeta et al. .

FOREIGN PATENT DOCUMENTS 85776 6/1958 Denmark .
2226068 11/1974 France .
9607508 3/1996 WIPO .

*Primary Examiner*—Derris H. Banks
*Attorney, Agent, or Firm*—Dykema Gossett PLLC

[57] ABSTRACT

An attachment means for attaching a sheet-formed abrasive and/or polishing means to a magnetized support, said attachment means comprising a ferromagnetic base layer and an external adhesive layer to which the abrasive and/or polishing means attached, and where said ferromagnetic base layer comprises a ferromagnetic metal foil and that said attachment means comprises a liner sheet having a first side adhered to a first side of the base layer by means of an internal adhesive layer, the liner sheet having the external adhesive layer disposed on the second side of the liner, the external adhesive layer being capable of releasably fixating the abrasive and/or polishing means and said external adhesive layer being capable of substantially retaining its adhesive capacity after removal of the abrasive and/or polishing means. The base layer is optionally and preferably provided with a friction increasing layer on the second side.

14 Claims, 1 Drawing Sheet

ATTACHMENT MEANS AND USE OF SUCH MEANS FOR ATTACHING A SHEET-FORMED ABRASIVE OR POLISHING MEANS TO A MAGNETIZED SUPPORT

BACKGROUND OF THE INVENTION

1. Field of the Invention

The present invention relates to an attachment means for facilitating the attachment of a sheet-formed abrasive or polishing means, such as abrasive paper, to a magnetized support, such as a magnetized rotatable supporting plate in an apparatus for performing abrasion and/or polishing.

2. The Prior Art

In the art of materiallography (the study of materials, e.g. metals) it is common practice to grind and/or polish the samples before performing the various analysis on them. For most analysis it is crucial that the surface of the sample to be analyzed is as smooth as possible.

Accordingly a great number of abrasive and polishing means, e.g. in terms of abrasive sheets having various grinding grain sizes are used. The treatment of a material-lographic sample normally starts with an abrasive sheet having a relatively large grain size and eventually ends up with an abrasive sheet having a very small grain size and/or a polishing cloth, the process comprising a number of treatment steps using means each having different and gradually reduced grain sizes. It is therefore crucial that the changing of the abrasive means is as simple and easy as possible. Furthermore it is desirable that the reuse of not completely worn out abrasive means is facilitated.

It is known to provide the back of abrasive paper with an adhesive layer and to attach the abrasive paper to a rotatable supporting plate by means of the adhesive layer.

It is also known to attach sheet-formed abrasive or polishing discs to a rotatable supporting plate by using magnetic force. Such a grinding and polishing machine comprising a rotatable magnetized supporting plate is common in the art of materiallography, and it is thus desirable that any equipment for use in said art is adapted or adaptable for use in such type of machine.

Thus, from U.S. Pat. No. 4,667,447 an abrasive disc is known comprising a plastic basis layer being coated on one side with a layer of abrasive grains and in which ferromagnetic particles are embedded in an amount sufficient for retaining the abrasive disc to a rotatable magnetic supporting plate with sufficient force for the abrasive disc in use hereof whereby the supporting plate is rotated not to be turned in relation to the latter.

According to U.S. Pat. No. 4,667,447 it is inexpedient to replace the plastic basis layer with embedded ferromagnetic particles by a thin metal foil, as the abrasive disc hereby becomes too rigid to be usable for abrading curved plates.

The abrasive discs mentioned in the said U.S. patent may for example be prepared from a conventional abrasive disc by adhering to its back a so-called liner consisting of an abrasive layer and a basis layer containing particles of a ferromagnetic substance.

When using a thus modified abrasive disc it is positioned directly on the rotatable magnetized supporting plate.

It is a significant disadvantage of the known method described above of attaching a sheet-formed abrasive or polishing means to a magnetic support that after wearing-down of the layer of abrasive grains it is necessary to dispose of the entire combination of abrasive disc, adhesive layer and ferromagnetic layer.

Accordingly the said method is both expensive to use and inappropriate from an environmental point of view. It is thus desirable to obtain a method of attaching a conventional abrasive sheet to a magnetized support without the use of excess material which has to be discarded along with abrasive sheet.

Another way of temporarily attaching an abrasive sheet to a rotatable support is disclosed in EP-B1-0 005 161. This document discloses an abrasive sheet having a backside comprising a release layer of polyamide or polyvinyl acetate copolymer material in order to enable an easy removable of the sheet from a support comprising an adhesive.

It is, however, inconvenient to place a layer of adhesive material directly on the magnetized support if the support is still to be used with ordinary magnetic tools. Furthermore, the adhesive material will eventually loose its adhesive effect, and replacement of the entire support or application of a new adhesive layer is both costly and troublesome.

Another disadvantage of having an adhesive layer on the support is that the applied abrasive sheets might not all have exactly the same size. Accordingly if the entire support is coated with an adhesive, and an abrasive sheet smaller than the support is used, some of the adhesive will be exposed to the dust, dirt and optional liquid from the grinding process and thus be adversely effected. On the other hand, if too small a part of the support is covered with adhesive, the adhesive effect might be too small and the abrasive sheet will be displaced or even detached during grinding having potentially even worse consequences.

A further downside of the system according to EP-B1-1 005 161 is that it is inconvenient that only a certain kind of abrasive sheets comprising a special release layer on the backside can be used.

Accordingly it is an objective of the present invention to provide a system which enables and facilitates the attachment and detachment of virtually any common abrasive sheet to a magnetized support in a grinding and/or polishing machine.

SUMMARY OF THE INVENTION

According to the invention this is obtained by means of an attachment means in the form of a inter-mediate layer comprising a ferromagnetic base layer and an external adhesive layer characterized in that said ferromagnetic base layer comprises a ferromagnetic metal foil and that said attachment means comprises a liner sheet having a first side adhered to a first side of the base layer by means of an internal adhesive layer, the liner sheet having the external adhesive layer disposed on the second side of the liner, the external adhesive layer being capable of releasably fixating the abrasive and/or polishing means and said external adhesive layer being capable of substantially retaining its adhesive capacity after removal of the abrasive and/or polishing means.

Such an attachment means can be adhered releasably to the backside of an ordinary abrasive or polishing means by means of the external adhesive layer and the attachment means can be placed and releasably fixed on the magnetized supporting plate by means of the magnetic force provided by the magnetized support. The order of said operations can be chosen freely.

The attachment means according to the invention accordingly makes it possible that a sheet-formed abrasive or polishing means, such as abrasive paper, after use, e.g. after wearing-down of the layer of abrasive particles, easily can be removed and replaced by a new piece of abrasive paper without any other costs than the costs for the abrasive paper itself.

Such an easy and economic replacement of abrasive paper is not only desirable after wearing-down of the abrasive paper but also in such cases where an abrasion or polishing is to be performed in several steps with abrasive or polishing means where the abrasive grains have different grain sizes.

For example coarse abrasion, fine abrasion and polishing are performed with abrasive grains normally having decreasing grain sizes.

If the external adhesive layer of the attachment means following repeated replacements of the sheet-formed abrasive or polishing means also needs replacement, it is an easy task to replace the attachment means by grasping an edge of the attachment means and pulling this edge away from the magnetic support and thus replacing the attachment means with a new one.

On the other hand, the attachment means is under the influence of strong magnetic forces in the horizontal direction when it is in a plane position on the surface of the magnetic support and thereby ensures that the abrasive or polishing means does not slip in relation to the support during abrasion or polishing. A contributory factor is that the items to be abraded or polished will normally be urged against the abrasive or polishing means during the abrasion or polishing.

Besides possessing higher mechanical strength than a plastic basis layer containing particles of a ferromagnetic substance, a foil of a ferromagnetic substance, such as an iron foil, has smaller resilience and a better heat conductivity, so that the frictional heat which is generated during the abrasion or polishing can be discharged via the supporting plate.

It is preferred to use a ferromagnetic foil having a thickness of 0.05–1 mm, as thinner foils do not have a desired strength, and foils having a larger thickness than 1 mm are so rigid that they impede removal from and mounting on the supporting plate. The thickness of the foil is preferably around 0.1 to 0.7 mm and more preferably around 0.25 to 0.35 mm, and it has turned out to be particularly expedient to use iron foils having a thickness of around 0.3 mm.

It has furthermore proven to be a great advantage to use a polymer liner as carrier means for the adhesive. Such a liner can be primed or corona treated as known in the art of production of adhesive tapes in order to make the adhesive material stick to the liner rather than the backside of the abrasive or polishing means when detaching said means form the attachment means. Hereby the use of virtually any abrasive or polishing means becomes possible regardless of the type of backside material. The typical and/or preferred abrasive or polishing means for use with the attachment means according to the invention has a siliconized backside composed of cloth or cardboard.

It is a further great advantage of using a liner sheet that different adhesives can be applied on each side of said liner, i.e. the internal and external adhesive layers can be composed in different manners. When the adhesive layers are fixed to the liner by previous priming or corona treatment it is possible to tailor the adhesive forces to suit practically any situation.

Accordingly it is possible to ensure that the adhesive force between the liner and the sheet metal is greater than between the liner and any abrasive or polishing means even if they have a backside comprising the same type of sheet metal.

According to a preferred embodiment of the attachment means according to the invention, the liner comprises two different types of adhesive compositions, one disposed on each side. Preferably the internal adhesive layer facing the ferromagnetic foil constitutes the largest adhesive force of the two compositions.

It has, however, surprisingly been found that using the same adhesive composition on both sides of the liner will be suitable for far the most applications. It is believed that this is at least partly due to the fact that the base layer comprising a ferromagnetic foil has a completely planar and uniform surface at the time where the adhesive is applied thereon, and that the adhesive thus sticks particularly efficient to the surface of the base layer comprising the ferromagnetic foil compared to e.g. the backside of the later on applied abrasive or polishing means.

Accordingly another preferred embodiment of the attachment means according to the invention comprises a polymer liner having the same adhesive composition disposed on both sides. This embodiment has the further advantage that it is particularly easy to produce, because only one type of adhesive composition is used, and furthermore no control has to be made in regard to which side of the liner is applied on the ferromagnetic foil and which side is eventually facing the abrasive or polishing means.

Another advantage of using a liner having an adhesive layer disposed on both sides is that it is virtually impossible to apply an adhesive layer directly on the sheet metal in a technical suitable and efficient manner. While the polymer liner is flexible and easy to handle when e.g. priming the liner and applying adhesive to the liner surfaces, it is rather complicated and/or costly to handle a sheet metal foil in a similar manner. For instance the sheet metal is not in practice sufficiently bendable and consequently machinery for processing such sheet metal has to work in a more or less linear manner taking up more space than needed and being more complicated than machinery for producing the attachment mean according to the invention.

The adhesive coated liner sheet should generally and preferably evoke the greatest possible adhesive capacity towards base layer comprising the foil of ferromagnetic substance, and in relation thereto the adhesive coated liner should preferably exhibit such an internal adhesive strength of at least 10 N/25 mm, preferably at least 13 N/25 mm and more preferably at least 15 N/25 mm.

In relation to the sheet-formed abrasive or polishing means the external adhesive layer must ensure that the sheet-formed means is not released under the influence of the forces parallel to the surface of the sheet-formed material which arise during the abrasion or polishing process, and at the same time that the sheet-formed material without breaking can be removed after use. Consequently, it is desirable that the external adhesive in relation to the sheet-formed abrasive or polishing means exhibits an adhesive strength of 3–15 N/25 mm, preferably 5–12 N/25 mm. However, generally the external adhesive strength towards the abrasive or polishing means should be less than the internal adhesive strength towards the ferromagnetic foil.

The adhesive strength of an adhesive composition is specific in relation to a certain material, e.g. most adhesives would have a higher adhesive strength sticking to a sheet of iron foil compared to a foil of Teflon®. The adhesive capacity of an adhesive can be measured by means of as tape test, which defines the force in Newton necessary to remove a 25 mm long piece of tape coated with the adhesive form a standardized surface, e.g. steel.

When mounting the sheet-formed abrasive or polishing means on the adhesive layer of the attachment means it is important that the sheet-formed abrasive or polishing means is made to lie completely plane. As a consequence hereof it is important to prevent air bobbles from forming between the sheet-formed abrasive or polishing means and the attachment means. According to the invention this is obtainable by using a structured external adhesive layer, i.e. an adhesive layer the top side of which is provided with protrusions and recesses, and where the recesses during and after mounting the sheet-formed abrasive or polishing means form ducts through which any air build-up can be discharged.

It is noted that the adhesive strength can be adjusted by the type of amount of optional structuring of the surfaces of the adhesive layers. Preferably at least the external adhesive layer facing the abrasion or polishing means is structured. Furthermore the adhesive strength can be controlled by the amount of adhesive material disposed on each side of the liner.

Examples of useful adhesives for forming the adhesive layers include rubber or acryl-based adhesives.

Particularly suitable are the adhesives used in the art of producing removable adhesive tapes, and particularly advantageous and preferable has proven such adhesives used on adhesive tapes for temporarily fixating printing blocks and the like in the art of typography.

The liner sheet can be of any material capable of being coated with an adhesive layer on each side. Preferably the liner is capable of being primed and/or corona treated in order to fixate the adhesive material of the liner. A suitable and preferable liner comprises PVC, PET, PP or another similar polymer.

The magnetic force holding a sheet iron plate suitable for the production of an attachment means according to the invention fixed on the magnetic support is in the horizontal direction typically in the order of magnitude of about 0.10 to 0.20 N/cm$^2$, preferably around 0.23 to 0.17 N/cm$^2$. A magnetic force in this order of magnitude makes it easy to detach the attachment means from the magnetic support. Furthermore it is a suitable force for fixating the attachment means to the support during polishing and lighter grinding.

However, when performing grinding where the friction force between the abrasive means and the sample is large, the ordinary attachment means might be displaced relative to the support, which is highly undesirable. Nevertheless, it is generally undesirable to increase the magnetic force between the support and the attachment means because of thus increased cost of production and because the detachment of the attachment means will become too troublesome.

Accordingly it has proven advantageous to increase the friction between the attachment means and the magnetic support.

According to the invention this is obtainable by providing the side of the foil facing the supporting plate with a thin, friction-increasing coating, such as a coating of a plastics, in terms of a synthetic resin, in which fine, hard particles are embedded, such as particles of $Al_2O_3$, diamond or SiC. The plastics coating is preferably so thin that the hard grains which preferably have a grain size from F220 to F320, project above the top side of the plastics coating and hereby can be brought into direct contact with the magnetic support.

By applying such a friction increasing layer according to the invention, it has proven possible to increase the friction coefficient to the double in horizontal direction between an attachment means according to the invention and the magnetized support. For example the force for parallel displacing an attachment means according to the invention and comprising a 0.280 mm thick sheet iron plate relative to the support is increased from about 0.15 N/cm$^2$ to about 0.25 to 0.35 N/cm$^2$, as measure with no pressure applied to the attachment means.

The thin plastics layer can e.g. consist of or comprise epoxy, polyester, polyurethane or acrylic plastics.

The invention also relates to the use of the attachment means according to the invention for attaching an abrasive or polishing means to a magnetized support in an apparatus for grinding or polishing.

The attachment means according to the invention is particularly suitable for use in a grinding and/or polishing apparatus comprising a planar rotatable magnetized support plate having a diameter of around 20–25 cm, e.g. of the type Struers® Rotopol-21.

Such a plate is typically rotated by a speed of approximately 150/300 rpm.

During some types of grinding and/or polishing it is common to use a fluid as coolant and/or lubricant, e.g. in terms of water and/or alcohol. It is a particularly greater advantage of using the attachment means according to the invention that such use of the commonly known grinding and/or polishing fluid does substantially not impair the short and/or long term efficiency of the attachment means.

It is a great advantage of using the attachment means according to the invention for temporarily fixating a abrasive and/or polishing means according to the invention that the attachment means can be reused a large number of times, thus reducing costs significantly.

Depending on the type of adhesive used and the use of optional lubricants, such as alcohols, during the abrasion or polishing, the typical attachment means according to the invention can be used about 100 times before it must be discarded. This is a great improvement over the prior art, where the known attachment means is for one-time use only.

The invention furthermore relates to a method of producing an attachment means according to the invention comprising the steps of applying a double sided adhesive tape on a first side of a ferromagnetic base layer and cutting said base layer and double sided adhesive tape in the desired shape. The base layer and double sided adhesive tape can be cut in any order suitable.

According to a preferred embodiment of the method according to the invention, the method furthermore comprises the steps of applying a mixture of an epoxy resin and hard particles on the second side of the base layer and curing said epoxy resin.

The term ferromagnetic material as used herein designates all types of metals and metal alloys which can be magnetized and/or attracted by a magnet, e.g. iron. The term magnetized support as used herein designates any support being capable of fixating a ferromagnetic metal, i.e. a support comprising one or more magnets. The magnetic force of the magnetized support can be provided by any means such as any number of static- and/or electromagnets.

In the following the invention is described in more detail, reference being made to the illustrations.

DETAILED DESCRIPTION OF THE PREFERRED EMBODIMENTS

Figure 1:
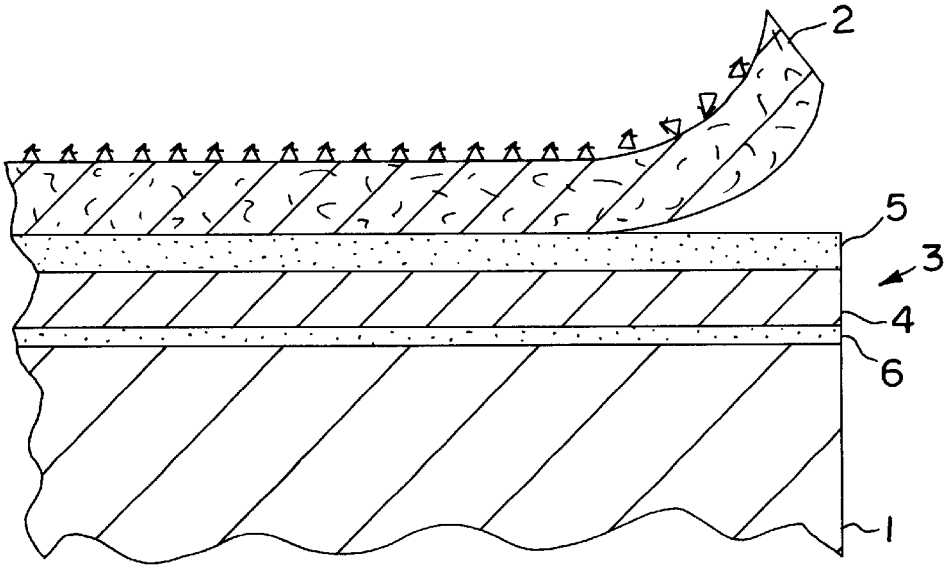
FIG. 1 schematically illustrates a magnetic support to which a piece of abrasive paper has been attached in a preferred embodiment of the method according to the invention.

In FIG. 1, 1 is a magnetic rotatable supporting plate to which a piece of abrasive paper 2 is attached. The attachment has been provided by means of an attachment means in terms of an inter-mediate layer, generally designated 3, and which comprises a ferromagnetic foil 4 which on the side facing the abrasive paper 2 is coated with a layer 5 of an adhesive, and on the opposite side with a friction-increasing layer 6 of an synthetic epoxy resin in which fine SiC-particles are embedded.

As indicated in the drawing, the abrasive paper 2 can be removed from the adhesive layer 5 without removing this from the ferromagnetic foil 4.

Figure 2:
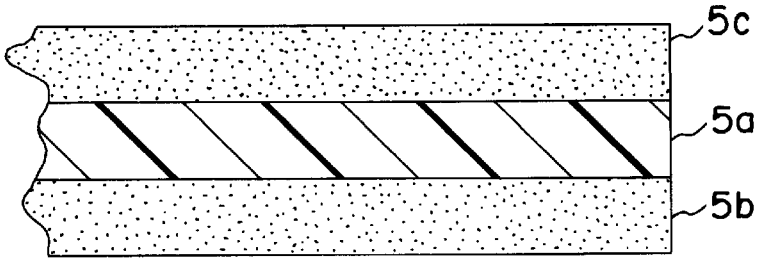
FIG. 2 schematically illustrates a liner sheet comprising 2 adhesive layers.

In FIG. 2, 5*a* designates a polymer liner sheet comprising a first adhesive layer 5*b* at one side and a second adhesive layer 5*c* at the second side.

Figure 3:
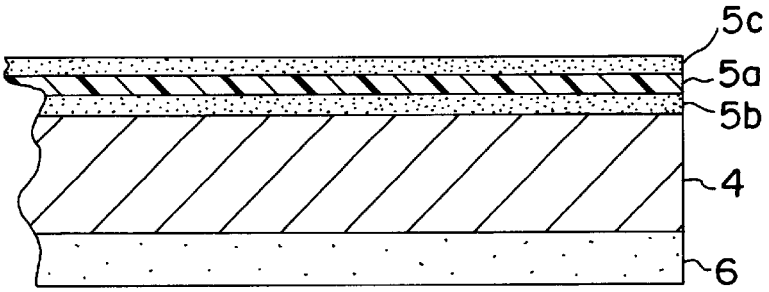
FIG. 3 schematically illustrates a preferred embodiment of an attachment means according to the invention.

FIG. 3 illustrates a preferred embodiment of the attachment means according to the invention 3, in terms of an intermediate layer comprising a ferromagnetic foil 4, an adhesive sandwich comprising a liner sheet 5*a,* a first internal adhesive layer 5*b* between the liner and the ferromagnetic foil mutually fixating said liner and said foil, and a second external adhesive layer 5*c* for releasably fixating an abrasion and/or polishing means, and a friction increasing layer 6 comprising a synthetic epoxy resin comprising a number of fine SiC-particles.

In the following the invention is illustrated in more detail, reference being made to the examples below of preparation of preferred embodiments of an attachment means according to the invention.

EXAMPLE 1

On a circular tinned sheet iron plate having a thickness of 0.3 mm a commercially available double-adhesive tape of the type TESA® 52320, i.a. used for cliché mounting, was rolled out. The adhesive tape consisted of a thin PVC foil being coated on its top side with a structured rubber-based adhesive, and on its bottom side with an acryl-based adhesive, and its top side being covered by a thin protective foil of polypropylene.

A mixture of epoxy resin and SiC-grains having a particle size of F220 and in a weight ratio of 1:1 was applied to the back of the circular tinplate on which the epoxy resin was made to cure.

EXAMPLE 2

A commercially available double-sided adhesive tape of the type TESA® 52310PV3, which amongst other thing is used for mounting printing blocks, is rolled onto a circular sheet iron plate having a thickness of 0.280 mm. The adhesive tape is composed by a thin polymer liner which has been treated with a primer or by corona treatment to facilitate fixation of the adhesive to said polymer material and then coated on both sides with a layer of a rubber based adhesive. The one side of the tape is covered with a thin protective foil of polypropylene and the adhesive layer on the opposite side is exposed thus used directly for fixating the tape on the sheet iron. The protective foil is kept on external adhesive layer of the attachment means until the initial use thereof.

A mixture of an epoxy resin and SiC grains having the particle size F220 is mixed in a density ratio of 1:1 and is then applied to the backside of the above mentioned circular sheet iron foil and cured. The typical horizontal displacement force between the magnetic support and the attachment means provided in the present example is around 30 N/cm$^2$.

What is claimed is:

1. An attachment means for attaching at least one of a sheet-formed abrasive or polishing means to a magnetized support, said attachment means comprising a ferromagnetic base layer and an external adhesive layer with an adhesive capacity to which the sheet-formed means is to be attached, characterized in that said ferromagnetic base layer comprises a ferromagnetic metal foil and that said attachment means comprises a liner sheet having a first side adhered to a first side of the base layer by means of an internal adhesive layer, the liner sheet having the external adhesive layer disposed on the second side of the liner, the external adhesive layer being capable of releasably fixating the sheet-formed means and said external adhesive layer being capable of substantially retaining its adhesive capacity after removal of the sheet-formed means, and that the second side of the base layer comprises a friction increasing layer.

2. An attachment means according to claim 1, characterized in that the ferromagnetic foil substantially consists of iron.

3. An attachment means according to claim 1, characterized in that the ferromagnetic foil has a thickness of 0.05–1 mm.

4. An attachment means according to claim 1, characterized in that the ferromagnetic foil has a thickness of 0.25–0.35 mm.

5. An attachment means according to claim 1, characterized in that the internal and external adhesive layers comprise identical adhesive compositions.

6. An attachment means according to claim 1, characterized in that the internal and external adhesive layers comprise different adhesive compositions.

7. An attachment means according to claim 1, characterized in that the internal adhesive layer has an adhesive capacity of at least 15 N/25 mm against the base layer.

8. An attachment means according to claim 1, characterized in that the external adhesive layer has an adhesive capacity towards the abrasive and/or polishing means of 5–12 N/25 mm.

9. An attachment means according to claim 1, characterized in that the external adhesive layer has a structured surface.

10. An attachment means according to claim 1, characterized in that the external adhesive layer consists of a rubber-or acryl-based adhesive.

11. An attachment means according to claim 1, characterized in that the friction increasing layer comprises a number of fine hard particles incorporated in a synthetic resin.

12. An attachment means according to claim 1, characterized in that the fine hard particles have a grain size form F220 to F320.

13. An attachment means comprising a ferromagnetic base layer and external adhesive layer to which at least one of an abrasive or polishing means is to be attached, where said ferromagnetic base layer comprises a ferromagnetic metal foil and where said attachment means comprises a liner sheet having a first side adhered to a first side of the base layer by means of an internal adhesive layer, the liner sheet having the external adhesive layer disposed on a second side of the liner, the external with an adhesive capacity being capable of releasably fixating the abrasive or polishing means and said external adhesive layer being capable of substantially retaining its adhesive capacity after removal of at least one of the abrasive or polishing means for releasably attaching at least one of a sheet-formed abrasive or polishing means to a magnetized support in an apparatus for at least one of grinding or polishing.

14. A method or producing an attachment means comprising the steps of adhering a double sided adhesive tape to a first side of a ferromagnetic base layer by means of an internal adhesive layer disposed on one side of said double sided adhesive tape, applying a mixture of an epoxy resin and hard particles on a second side of the base layer, and curing said epoxy resin and cutting said base layer and adhesive tape in a desired shape.

* * * * *